United States Patent [19]

Isaacson

[11] 4,083,652

[45] Apr. 11, 1978

[54] INFLATABLE AIR-DRIVEN MOTOR

[76] Inventor: Boris Isaacson, 14532 Vanowen St., Van Nuys, Calif. 91405

[21] Appl. No.: 651,187

[22] Filed: Jan. 21, 1976

Related U.S. Application Data

[63] Continuation-in-part of Ser. No. 634,620, Nov. 24, 1975, Pat. No. 3,990,808.

[51] Int. Cl.[2] ..... F04D 29/18

[52] U.S. Cl. ..... 416/84; 415/141; 416/240

[58] Field of Search ..... 416/240, 227 A, 141, 416/200, 84; 290/55, 44, 43, 54

[56] References Cited

U.S. PATENT DOCUMENTS

| | | | |
|---|---|---|---|
| 1,868,113 | 7/1932 | Ljungstrom | 416/240 |

FOREIGN PATENT DOCUMENTS

| | | | |
|---|---|---|---|
| 406,691 | 12/1909 | France | 416/227 A |
| 45,375 | 8/1909 | Germany | 416/227 A |
| 49,065 | 12/1909 | Germany | 416/227 A |
| 166,460 | 7/1921 | United Kingdom | 416/230 |

*Primary Examiner*—Robert K. Schaefer
*Assistant Examiner*—John W. Redman
*Attorney, Agent, or Firm*—I. Morley Drucker

[57] ABSTRACT

A centrifugal air-driven motor, or windmill, is disclosed wherein the blades thereof are made of a pliable, flexible, uniformly apertured sheeting made, for example, of plastic, affixed by a flexible support system, to a central rotatable shaft, so that as the apertured plastic sheet is moved centrifugally outwardly, under the influence of wind energy, the solid portions of the plastic sheet assume the shape of blades; further, the blade support system is made completely of thin, flexible, pliable, material, such as plastic, and the blades may assume different, e.g., forward curved, radial, or backward inclined configurations, during rotation of the windmill. The blades and support means therefor, are affixed to a central, axial, rotatable shaft. As the blades are driven, by wind force, their rotation is transmitted to the rotatable, axial, shaft through the blade support means, to thereby cause rotation of the axial shaft. The shaft rotation is transmitted to a generator, or other means, for making use of the energy collected by the windmill of this invention. Windmills following this principle can be made of enormous size, e.g., 50 – 150 feet or greater in diameter, and can deliver millions of horsepower. The inflatable air motor here disclosed is lighter, and more compact, when deflated, than comparably-sized rigid windmills. At the same time, performance of the centrifugal air motor here disclosed generally conforms to that of similarly sized rigid windmills in rpm and horsepower delivered.

13 Claims, 6 Drawing Figures

INFLATABLE AIR-DRIVEN MOTOR

CROSS-REFERENCE TO RELATED APPLICATIONS

This application is a continuation-in-part of my application entitled "INFLATABLE BLOWER" filed Nov. 24, 1975 and bearing Ser. No. 634,620 now U.S. Pat. No. 3,990,808.

BACKGROUND OF THE INVENTION

Air motors, or windmills, are generally constructed with radially mounted rigid canted blades. The windmills of this type are usually expensive, bulky and heavy. The maximum size, to which they can be made, is therefore quite limited, and are generally under 50 feet in diameter.

Prior art windmill constructions have not, insofar as I am aware, developed a flexible blade construction made essentially of low cost, light weight, plastic sheeting for the purpose of rendering the air motor very light and inexpensive to manufacture — in comparison to air motors having conventional rigid, e.g., metal blades and conventional rigid frame support means for the blades.

SUMMARY OF THE INVENTION

The centrifugal air motor of this invention is directed towards the combination of the following elements:

(a) a rotatable shaft or rotor;

(b) a plurality of blade means made of thin, flexible, plastic or plastic-reinforced apertured sheeting; and (c) a collapsible support means for the blade means, preferably in the form of series of flexible, plastic or reinforced plastic cables, or strips, affixed to the rotatable shaft, and spacedly supporting the blade means away from the rotor, whereby the cable supports for the blade means are forced radially outwardly under wind force, and the blade means assume a specific predetermined, arcuate shape, and air is forced outwardly from the air motor through a series of apertures adjacent to the blade means. The blade means are thereby rotated, under the influence of wind force, and their rotation is transmitted, via the blade support means, to the rotor. The rotor is thereby rotated and its rotational movement is transmitted, to means for storing or making use of the energy collected directly, e.g., by means of a generator. The area of air inlet to the air motor is equal to, or less than, the air of air exhaust provided by the apertures in the blade means for maximum efficiency.

Very large diameter windmills, pivotally mounted to follow the direction of the wind, can be made, relatively inexpensively. Diameters of the order of 50 feet to 150 feet or larger, together with 50 feet to 150 feet windmill lengths, are entirely possible. It is estimated that the horsepower generated by such large diametered and long windmills will be in the order of millions of horsepower.

Priming of the air motor of this invention can be accomplished, if necessary (where wind velocity is below a few miles an hour) by a smaller air motor, of the type described herein, or by a conventional motor, which will drive the rotatable shaft of the main air motor.

DETAILED DESCRIPTION OF THE PREFERRED EMBODIMENT

Figure 1:
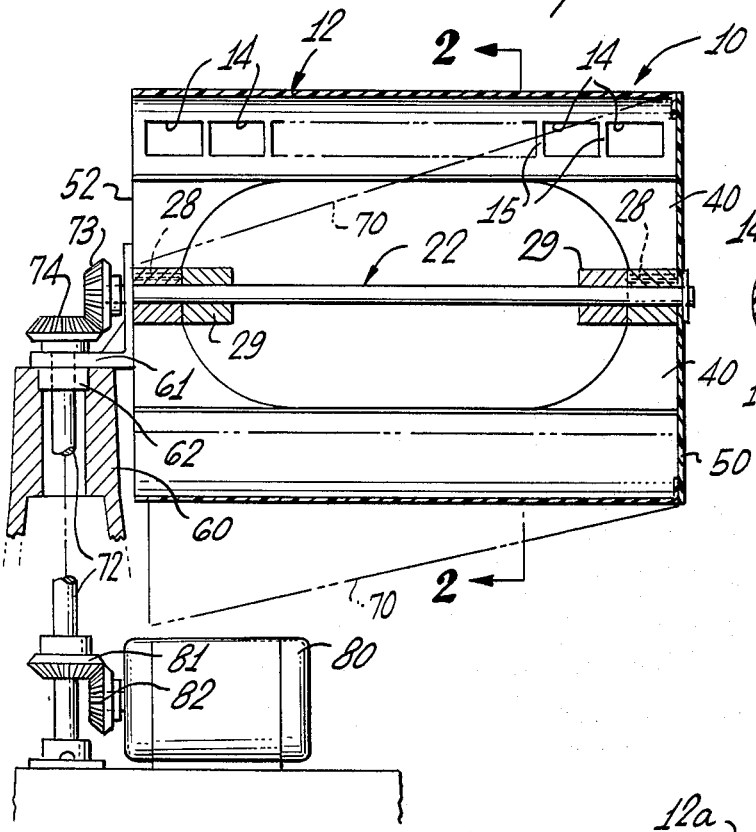
FIG. 1 is a fragmentary, elevational view in axial cross-section, of the centrifugal air motor of this invention, in inflated condition, during operation.

The inflatable air motor 10 of my invention comprises an inflatable blade means 12 made of plastic sheeting mounted to a rotatable shaft or rotor 22 by a flexible support means 40, the assembly constituting the air motor. The blade means 12 and flexible supports 40 therefore may be made entirely of thin, flexible plastic sheet thereby enabling tremendous reductions in terms of weight, size (in deflated condition) and cost, without sacrifice in air delivery and other power requirements, in comparison to conventional air motors having rigid blades (e.g., performed metal or plastic blade means) and rigid supports therefor.

Figure 2:
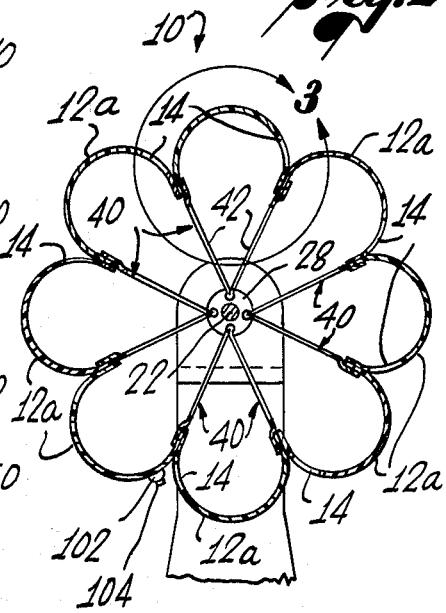
FIG. 2 is a transverse, cross-section view, in end elevation, taken along the line 2—2 of FIG. 1.
Figure 3:
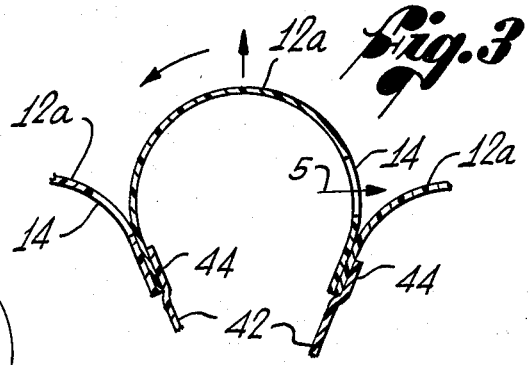
FIG. 3 is a fragmentary, enlarged, cross-sectional view, of that portion of FIG. 2, taken along the arcuate line 3 of FIG. 2.

The inflatable blade means 12 comprises, in a preferred embodiment, a uniformly apertured, thin, flexible, collapsible, endless plastic sheet, as best seen in FIGS. 1, 2 and 3, the apertures formed therein being designated by the numeral 14. The apertures 14 are bound by thin, flexible plastic aperture strips 15, the aperture strips 15 joining adjacent portions of blade means 12 to form adjacent blades **12*a***.

The blade means 12 may be made from a unitary sheet with the apertures 14 cut out, or may be made up from smaller sheet segments which are welded together to form the sheet. Various types of plastic sheeting materials may be employed, such as polyvinyl chloride (pvc), or nylon-reinforced pvc. Also, other types of materials may be employed such as rubber sheeting or fabric sheeting.

A flexible, collapsible, plastic cable support system 40 made, for example, of a pvc plastic or reinforced pvc plastic, mounts the plastic sheet blade means 12 (the solid portions of which form a plurality of blades **12*a* when the air motor is operative) to an air-driven shaft or rotor as best seen in FIGS. 2, and 3. A plurality of cable support systems are provided, one for each blade 12*a*. The plastic cable-support system comprises, for each blade 12*a*, a plurality of diverging pvc cables or strips 42, the outer ends of which are all joined by, or merged into, a pvc plastic welding strip, designated 44. Each plastic welding strip 44 is preferably affixed to the interior of each blade 12*a***, by heat welding in a conventional manner, e.g., by ultrasonic welding techniques.

Figure 6:
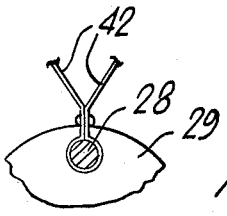
FIG. 6 is an expanded, fragmentary, cross-sectional view, taken along the arcuate line 6.

Referring to FIG. 6, in particular, the inner ends of each set of pvc strips 42 of the cable support systems are wrapped around, and affixed to, a metal cylinder 28, which cylinder is, in turn, stably mounted within an appropriately slotted end of a secondary hub 29, affixed to the end of rotor 22. In the particular embodiment shown, each cylinder 28 has affixed thereto the inner ends of two cable support systems. A pair of cylinders 28 are mounted to each end of rotor 22. Thus, it will be seen that eight separate cable supports 42 are welded, at their outer ends, to eight separate blades 12*a* and are stably affixed to rotor 22. Of course, a different number of blades 12*a* may be employed which will, in turn, alter the number of cable support systems required.

The blade support system 40, comprising basically cables 42 and welding strips 44, spacedly support the blade means 12 away from the rotor 22 a radial distance substantially greater than zero so that, when the rotor is driven, as by wind, the cable supports 42 are forced radially outwardly, under centrifugal force as shown in FIG. 2, and the blades 12*a* become peripherally spaced from each other as best seen in FIG. 2.

While the support system just described is presently preferred, other support means for mounting blades 12*a* may be provided.

The right (or outer) end of the air motor as viewed in FIG. 1 is blocked off by an end panel 50, made of thin, flexible, plastic (e.g., pvc or fiber reinforced pvc plastic). End panel 50 is impervious to air and prevents air from moving through the outer end of the air motor 10.

The inner, or air entry port, end 52 of the air motor 10 is open to allow wind to pass thereinto and inflate the blade means 12. To this end, the air motor 10 is pivotally mounted to a hollow standard, or post 60, in a conventional manner, so that it will automatically be aligned with shifting wind directions, (e.g., by means of yoke 61 and collar 62).

Upon counter-clockwise rotation of the rotor 22, by means of wind force above a velocity of several miles per hour, e.g., 5 miles per hour, the plastic blade means 12*a*, and the plastic cable support system 40 therefor, move from the limp, or deflated condition shown in dotted line 70 in FIG. 1, to the inflated condition shown in FIGS. 1 and 2. The air motor 10 draws air in through the inner end 52 of the air motor to cause the inflated condition of the blade means 12 in FIGS. 1 and 2 to occur.

Air moves outwardly from the air motor 10, through apertures 14, in the general direction of the arrow 5 (shown in FIG. 3) and the peripherally spaced blades 12*a* assume the forward-curved shaped shown in FIG. 2, and are rotated in the counterclockwise direction to cause movement of the rotor 22.

The rotor 22, in turn, drives a vertical shaft 72, which is mounted for rotation within the hollow post 60, through meshing upper gears 73 and 74. The rotation of shaft 72 is transmitted to a generator 80 (or other means, for storing the rotational energy) by means of lower gears 81, 82.

Figure 5:
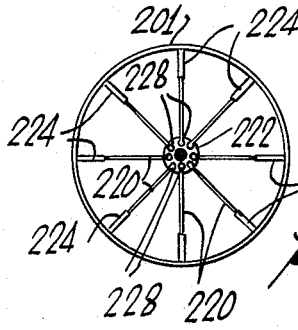
FIG. 5 is an end elevational view of a modified blade means, in inflated condition.

The blade means may also assume the configuration of a radial blade means, as seen in FIG. 5. In FIG. 5, a plurality of blades 224, made of thin, flexible, plastic rectangular, collapsible sheets are affixed to a rotor 222, by means of a cable support system, comprising, for example, a plurality of thin, flexible, plastic, collapsible strips 220. The outer periphery of each of the blades is held, in spaced relationship during rotation, by thin, flexible, plastic strips or bands 201, which join the outer edges of the blades 224. During rotation, the blades achieve a radial type configuration shown in FIG. 5. An outer end panel (not shown) is provided similar to end panel 50 in FIG. 1.

It will be seen from the foregoing that the blade means 12 is elongated in the direction parallel to rotor 22. Further, the area of the apertures 14 of the blade means may be smaller, equal to, or larger than, the inlet area of the air entry port 52 depending upon whether one wishes a high, medium, or low rpm of the air motor 10, respectively.

The air motor 10 may be primed, i.e., caused to initially inflate, by an auxilliary motor. The auxilliary motor may be electrically driven or may itself be smaller-diametered air motor, drivingly engaged with the air motor 10 described herein.

Furthermore, the air entry port 52 may be held open, by a rigid, open framework, if desired, to more readily achieve initial inflation of the air motor 10. This means is not presently preferred.

Figure 4:
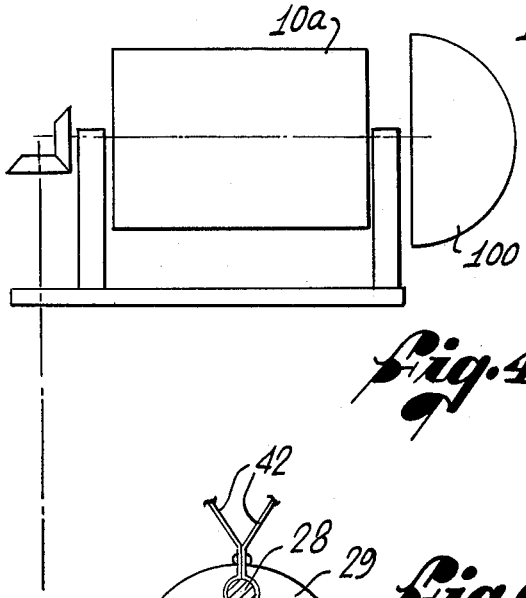
FIG. 4 is a schematic side elevational view of another embodiment of the air motor of this invention.

Referring now to FIG. 4, the motor 10*a*, similar to air motor 10, is shown, schematically, and is modified by having attached to the closed end 50 thereof, a rudder 100, for the purpose of more easily being self-aligned with shifting wind directions.

The blade means 12 of this invention may be weighted to any desired extent, for example, by means of water contained within a flexible plastic tube, which tube is, in turn, affixed to the exterior of each blade 12. Thus, for example, a water tube 102 is shown in FIG. 2 in dotted line, welded to a blade 12*a*. The tube 102 is provided with a water inlet spout 104. Other weighting or mass-producing means may be affixed to the blade means of this invention.

Modifications will occur to those skilled in the art, without departing from the essence of this invention. Hence, I intend to be bound only by the claims which follow.

I claim:

1. An air-driven motor which comprises:

a rotor;

a blade means comprising thin, flexible, collapsible sheeting forming a plurality of blades and apertures adjacent thereto;

flexible, thin, collapsible, support means for said blade means affixed to said rotor, said support means spacedly supporting said blade means a radial distance, greater than zero, away from said rotor; and air entry means directing air to said blade means whereby, as said air is directed to said blade means above a predetermined velocity, said flexable, thin, collapsible support means for said blade means are forced radially outwardly and said blade means are inflated to thereby force air outwardly through said apertures adjacent to said blade means, and said blade means and support means therefor are rotated causing said rotor to also be rotatably driven, the primary source of rotation of said rotor being said air directed onto said blade means.

2. The air-driven motor of claim 1 wherein said blade means is made, primarily, of plastic.

3. The air-driven motor of claim 1 wherein said blade means includes a plurality of flexible collapsible strips joining adjacent blades and defining said apertures.

4. The air-driven motor of claim 1 wherein said flexible, thin, collapsible support means comprises a plurality of cable supports.

5. The air-driven motor of claim 1 wherein each of said blades assumes a forward curve relative to the direction of rotation of said rotor.

6. The air-driven motor of claim 1 wherein each of said blades assumes a radial configuration relative to the direction of rotation of said rotor.

7. The air-driven motor of claim 1 which includes a rudder affixed to one end thereof.

8. The air-driven motor of claim 1 wherein mass producing means are affixed to said blades means.

9. The air-driven motor of claim 1 wherein said blade means is elongated in the direction parallel to the longitudinal axis of said rotor, and said air entry means is provided at one end only of said blade means.

10. The air-driven motor of claim 1 wherein said blade means is elongated in the direction parallel to the longitudinal axis of said rotor, said air entry means is provided at one end of said blade means, flexible, collapsible sheeting is affixed to the opposed end of said blade means to block air flow through said opposed end, and the area of said apertures of said blade means is approximately equal to, or less than, the inlet area of said air entry means when said air motor is inflated.

11. The air motor of claim 1 which includes means for pivotally mounting said air motor to cause said air-motor to be automatically aligned in accordance with the wind direction.

12. The air-driven motor of claim 1 in combination with priming means therefor.

13. The air-driven motor of claim 1 in combination with apparatus drivingly engaged to said rotor of said air motor for the priming of said air-driven motor.

* * * * *